US005941737A

United States Patent [19]

Sakai et al.

[11] Patent Number: 5,941,737

[45] Date of Patent: Aug. 24, 1999

[54] DOUBLE RETAINING CONNECTOR

[75] Inventors: Hitoshi Sakai; Hideki Ohsumi, both of Shizuoka, Japan

[73] Assignee: Yazaki Corporation, Tokyo, Japan

[21] Appl. No.: 09/021,129

[22] Filed: Feb. 10, 1998

[30] Foreign Application Priority Data

Feb. 10, 1997 [JP] Japan ..... 9-026454

[51] Int. Cl.[6] ..... H01R 13/514

[52] U.S. Cl. ..... 439/752

[58] Field of Search ..... 439/595, 488, 439/752

[56] References Cited

U.S. PATENT DOCUMENTS

| | | | |
|---|---|---|---|
| 5,085,598 | 2/1992 | Kinoshita | 439/595 |
| 5,458,511 | 10/1995 | Sasai et al. | 439/752 |
| 5,464,356 | 11/1995 | Nebeshima et al. | 439/752 |
| 5,618,195 | 4/1997 | Cappe | 439/157 |
| 5,643,009 | 7/1997 | Dinkel et al. | 439/595 |
| 5,697,814 | 12/1997 | Delaunay | 439/595 |
| 5,820,409 | 10/1998 | Clark et al. | 439/595 |

*Primary Examiner*—Steven L. Stephan
*Assistant Examiner*—Hal Moon Hyeon
*Attorney, Agent, or Firm*—Sughrue, Mion, Zinn, Macpeak & Seas, PLLC

[57] ABSTRACT

A double retaining connector having a terminal retaining member (4) movably mounted in an intermediate portion of a connector housing (1) having terminal receiving chambers (17). Cam pins (5) are formed on opposite side surfaces of the terminal retaining member to drive the terminal retaining member between a stand-by position, in which terminal receiving portions in the terminal retaining member communicate respectively with the terminal receiving chambers, and a retaining position, in which terminal retaining portions (6) engage the terminals. A detection member (8) having cam bars (9) with slide surfaces (cam groove 10) for engagement with the associated cam pin, is removably attached to a rear end of the housing. A short-distance movement of the terminal retaining member (4) from the stand-by position into the retaining position is effected through a long-distance movement of the detection member (8) in a direction parallel to the axes of the terminals.

10 Claims, 10 Drawing Sheets

DOUBLE RETAINING CONNECTOR

BACKGROUND OF THE INVENTION

1. Field of the Invention

This invention relates to connectors in general, and more particularly to connectors of the type having a terminal retaining member for retaining terminals in terminal receiving chambers.

2. Related Art

Generally, connectors retain a terminal in a terminal receiving chamber by engaging a stamped piece portion, formed on the terminal, with a bottom wall of the terminal receiving chamber of a connector housing. Alternatively, the terminal is retained by engaging an elastic retaining arm, formed integrally with a top surface of the terminal receiving chamber, with a shoulder of an electrical contact portion of the terminal or a hole formed therein. However, these connectors are not without shortcomings. In particular, the stamped piece portion and the retaining arm are small and delicate. Therefore, they are easily damaged when male and female connectors are repeatedly connected together and disconnected from each other, As a result, the terminal may inadvertently withdrawn from the terminal receiving chamber, thereby defeating an electrical contact therebetween.

Therefore, a construction is disclosed in Japanese Patent Examined Publication No. 4-23391, in which a through hole, communicating with terminal receiving chambers, is formed in a central portion of an outer peripheral wall of a housing. A terminal retaining member is inserted through the through hole in a direction perpendicular to the axes of terminals, and is located at one end portion of each of the terminals. Side surfaces of plate-like projections of the terminal retaining member are engaged respectively with the terminals, thereby providing a second means for retaining the terminals.

FIGS. 15(A) and 15(B) show such a double-retaining connector. FIG. 15(A) is a cross-sectional view before the second retaining feature is effected, and FIG. 15(B) is a cross-sectional view after the second retaining feature is effected. Reference numeral 50 denotes a connector housing, and reference numeral 51 denotes a terminal receiving chamber. An elastic retaining arm 52 is formed integrally in each terminal receiving chamber 51, and engages a shoulder at a rear end of an electrical contact portion of a terminal (not shown), thereby providing a first means to retain the terminal.

A terminal retaining member 53 inserts into a through hole 55, which is provided in an outer peripheral wall of the housing 50, and communicates with the terminal receiving chambers 51, in a direction perpendicular to the terminals, and projections 54 of the terminal retaining member 53 are retainingly engaged respectively in retaining grooves formed respectively in the terminals (not shown).

In FIG. 15(A), the terminal retaining member 53 is located at a lower position, and therefore the retaining projections 54 are also located at respective lower positions, so that the terminals can be inserted respectively into the terminal receiving chambers 51. Once the terminal is inserted into the terminal receiving chamber 51, the elastic retaining arm 52 engages the shoulder of the terminal, thereby effecting the first retaining means. Then, when the terminal retaining member 53 is pushed up, the retaining projections 54 are moved upward, and are engaged respectively with retaining portions of the terminals, respectively, thereby effecting the second retaining means, as shown in FIG. 15(B).

Such double retaining connectors are generally thought to be acceptable, however they too have associated shortcomings. In particular, the terminal retaining member 53 is moved in a direction perpendicular to the terminals. Therefore, the displacement (i.e., stroke) of the terminal retaining member 53 is very short. Moreover, the proper actuation of the second retaining means is determined by visually confirming whether or not the terminal retaining member 53 is projected from the housing 50. Since the projecting amount is very small, it is difficult to make a judgment at a glance. Further, incorrect judgements are likely in which the second retaining means is inadvertently left inoperative.

It is an object of this invention to provide a connector in which determining whether or not terminals are properly retained by a terminal retaining member can be easily judged from the outside.

SUMMARY OF THE INVENTION

The invention resides in a connector wherein a terminal retaining member, having terminal receiving portions and terminal retaining portions, is mounted in an intermediate portion of a connector housing having terminal receiving chambers, each having opposite open ends. The terminal retaining member is disposed substantially perpendicular to axes of terminals received respectively in the terminal receiving chambers, and is movable between a stand-by position in which the terminal receiving portions communicate respectively with the terminal receiving chambers, and the terminal retaining portions are disposed outside the terminal receiving chambers so as to enable the insertion and withdrawal of the terminals, and a retaining position in which the terminal retaining portions are received in the terminal receiving chambers, and engage the terminals. Cam pins are formed respectively on opposite side surfaces of the terminal retaining member. A detection member having cam bars, each having a slanting slide surface for engagement with the associated cam pin, is removably attached to a rear end of the connector housing. When the cam pins are engaged respectively with the slide surfaces, a short displacement of the terminal retaining member from the stand-by position to the retaining position is effected through a long displacement of the detection member in a direction parallel to the axes of the terminals.

In the above construction, the displacement (insertion stroke) of the cam bars for moving the terminal retaining member from the stand-by position to the retaining position is increased. Therefore, whether or not the terminals are properly retained by the terminal retaining member is judged by the inserted condition of the detection member which has a long stroke. In this way, visual determinations are easier and more accurate, such that the incomplete retaining and the failure to effect the second retaining means are prevented.

Provisionally-locking means for retaining the terminal retaining member in the stand-by position, as well as completely-locking means for retaining the terminal retaining member in the retaining position, are provided at the connector housing and the detection member. Therefore, the terminals can be inserted and withdrawn, with the detection member remaining attached to the connector housing to ease handling. Further, after the terminals are inserted, the withdrawal of the terminals is positively prevented by the completely-locking means.

An insertion detection piece portion is formed at a distal end of each of the cam bars of the detection member, and insertion detection holes are formed in a front wall of the connector housing. In a completely-locked position of the detection member, distal ends of the insertion detection piece portions are inserted respectively through the insertion detection holes, and can be viewed from the exterior. Therefore, whether or not the detection member is properly mounted, as well as whether or not the terminals are properly retained, can be judged from the front and rear sides of the connector housing.

The connector housing comprises a housing body having the terminal receiving chambers, and a front holder removably mounted on a front end portion of the housing body. The front holder has terminal receiving portions communicating respectively with the terminal receiving chambers. The terminal retaining member is movably mounted between the housing body and the front holder, and the housing body has through holes into which the cam bars are removably inserted from a rear side thereof, respectively.

The connector housing comprises a housing body having terminal receiving chambers at its front portion and a cavity at its rear portion, the terminal retaining member, and a rear holder are received in the cavity. Each of the terminal retaining member and the rear holder has terminal receiving portions communicating respectively with the terminal receiving chambers in the housing body. The cam bars of the detection member are removably inserted respectively into a gap between one side wall of the cavity and the rear holder and a gap between the other side wall of the cavity and the rear holder.

The connector housing is constituted by several separate parts (that is, the housing body and the front holder, or the housing body, the terminal retaining member and the rear holder). Therefore, molds for forming the connector housings are simplified in construction, and the molding of the connector housing, having the terminal receiving chambers of a complicated shape, is simplified.

Preferably, the terminal retaining member has elastic retaining arms for respectively engaging the terminals to effect the first retaining means. Each of the elastic retaining arms is provided at one side of the associated terminal receiving portion remote from the terminal retaining portions. By thus forming the elastic retaining arms (which provide the first retaining means) on the terminal retaining members, the molds are further simplified in construction, and dimensional accuracies can be enhanced.

A cam groove is formed in each of the cam bars. The cam groove has a slanting slide surface for engagement with the associated cam pin so as to move the terminal retaining member in a direction substantially perpendicular to the axes of the terminals. Accordingly, the cam pins and the terminal retaining member are moveable upward and downward. Therefore, the terminal retaining member is moveable from the stand-by position to the retaining position, and vice versa.

Preferably, a front end portion of the cam groove is a flared introduction portion for receiving the cam pin. By thus making the front end portion of the cam groove larger than the groove width, the terminal retaining member is brought into the stand-by position by slightly inserting the cam bars irrespective of the position of the terminal retaining member, and each terminal can be easily inserted into the terminal receiving chamber.

The detection member also serves as a rear housing constituting a rear end portion of the connector housing, and the cam bars are formed on the rear housing. Since the cam bars are formed on the rear housing constituting the rear end portion of the connector housing, the number of component parts of the connector housing is reduced, and time and labor required for an assembling operation are reduced.

Retaining means for retaining the rear housing on the connector housing also serves as lock means for locking the terminal retaining member, such that the cam bars are retained simultaneously when the rear housing is retained. Therefore, the construction of the connector is simplified.

DETAILED DESCRIPTION OF THE INVENTION

An embodiment of the present invention will now be described with reference to FIGS. 1 to 3.

Figure 1:
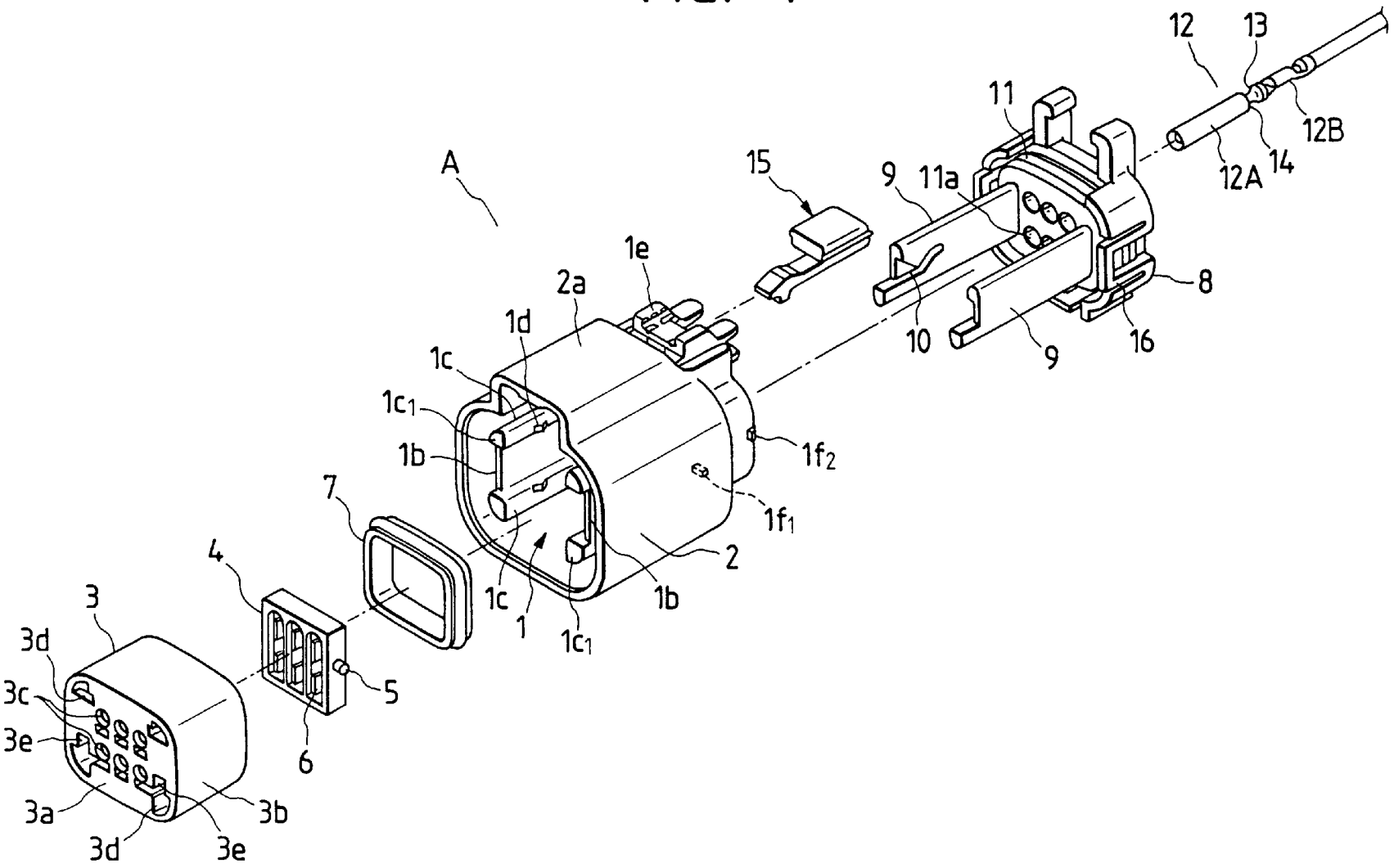
FIG. 1 is an exploded, perspective view of first embodiment of a double-retaining connector A of the present invention.

In FIG. 1, the connector A comprises a housing body 1 having a waterproof hood 2, a front holder 3, the terminal retaining member 4, a packing 7, a slider (detection member) 8, female terminals 12, and a spacer 15.

The slider 8 includes a pair of cam bars 9 and 9 each having a cam groove 10, and the spacer 15 serves to fix a locking arm of a mating connector (not shown). The female terminal 12 has a well-known construction, and includes an electrical contact portion (front portion) 12A of a tubular shape, a wire connection portion (rear portion) 12B, and a narrow neck portion 13 interconnecting the two portions 12A and 12B.

Figure 2A:
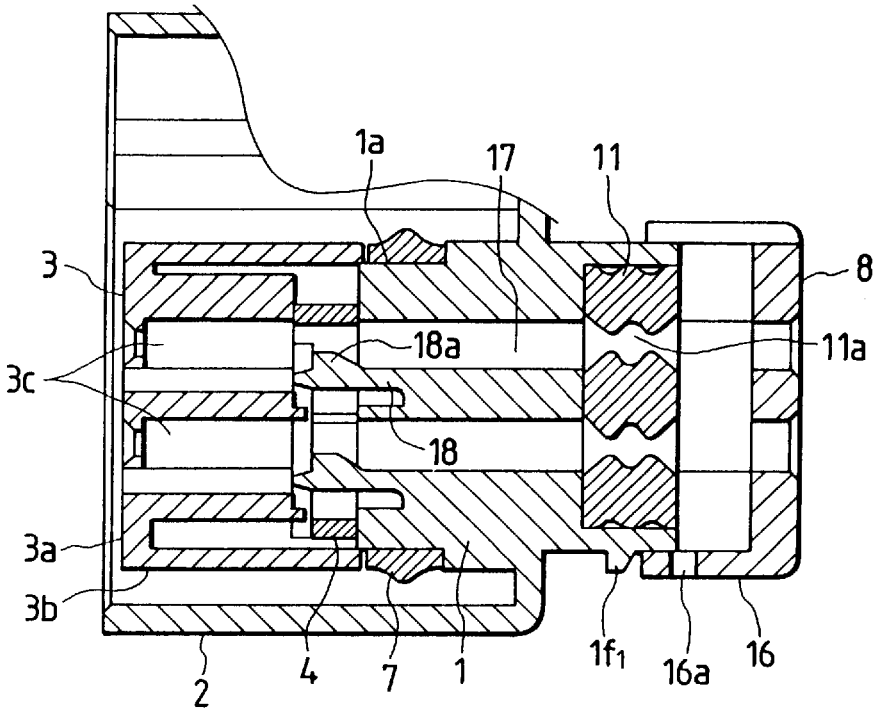
FIGS. 2(*a*) and 2(B) are vertical cross-sectional views taken along an axis of the connector of FIG. 1 in its assembled condition, FIG. 2(A) showing a condition before the double retaining of female terminals is effected, and FIG. 2(B) showing a condition after the double retaining is effected.
Figure 2B:
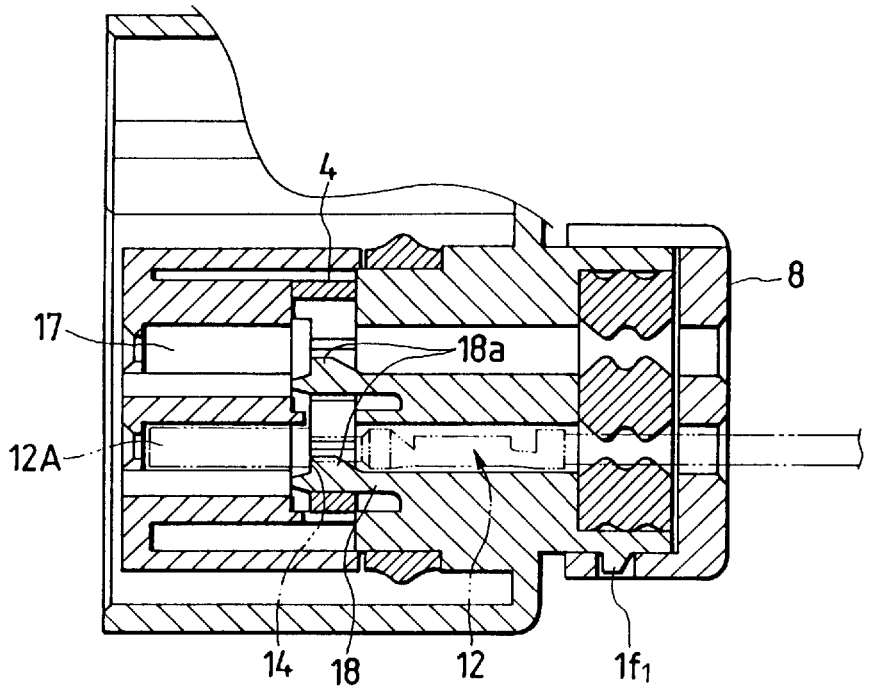
Figure 4:
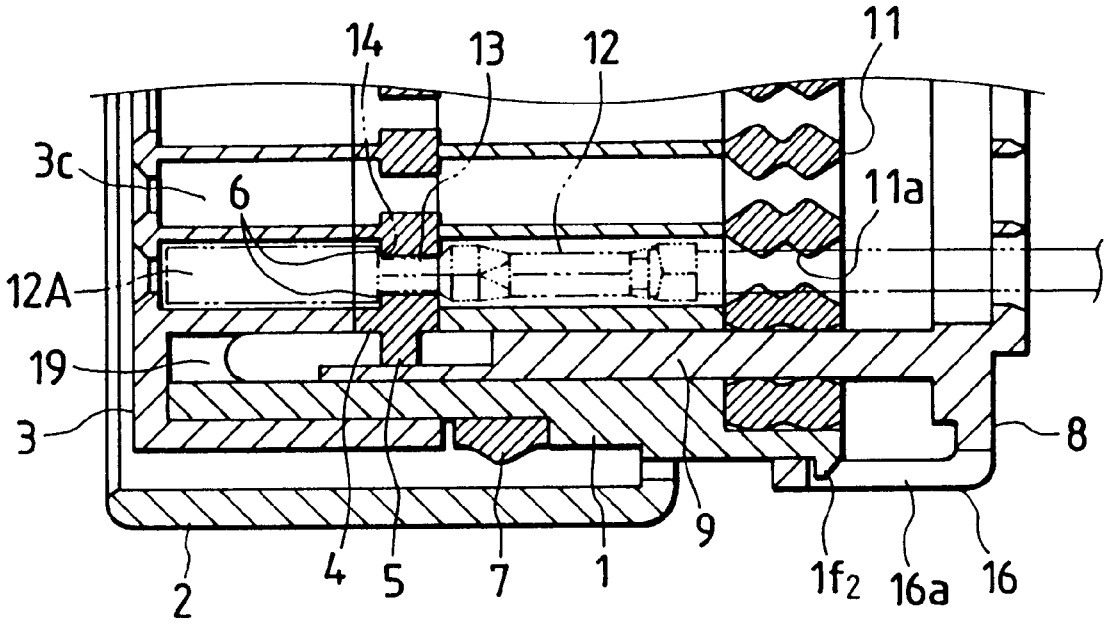
FIG. 4 is a cross-sectional view taken along the line IV—IV of FIG. 3(A)

As shown in FIGS. 2(A), 2(B) and 4, a plurality of terminal receiving chambers 17 are arranged in two (upper and lower) rows within the housing body 1 made of an insulating synthetic resin material, and an elastic retaining arm 18 for retaining the female terminal 12 is formed integrally on a bottom wall of each terminal receiving chamber 17. Through holes 19 for respectively receiving the cam bars 9 are formed in opposite (right and left) side portions of the housing body 1, and extend forwardly from its rear wall. When the cam bars 9 are inserted respectively into the through holes 19, the cam grooves 10, formed respectively in their front end portions, contact cam pins 5 of the terminal retaining member 4, respectively.

As described above, the waterproof hood 2 is formed integrally at a front half portion of an outer peripheral wall of the housing body 1 in a bulged manner. As shown in FIGS. 2(A), 2(B) and 3, the front half portion of this outer peripheral wall is stepped, and the front holder 3 is mounted on a front reduced-size portion 1*a* that extends through the packing 7. The reduced-size portion 1*a* has right and left side walls 1*b* and 1*b*, and is open upwardly and downwardly. Upper and lower edges of the side walls 1*b* are reinforced respectively by ribs 1*c* provided thereon. Each side wall 1*b* and the upper and lower ribs 1*c* jointly form an insertion guide groove for the associated cam bar 9 of the slider 8. A retaining projection 1*d* is formed on an inner surface of each of the ribs 1*c*, and a front end $1c_1$ of each rib 1*c* is slightly projected from a front end of the side wall 1*b*.

A spacer reception portion 1*e* is formed at an upper side of a rear half portion of the outer peripheral wall of the housing body 1, and faces a passage 2*a* formed in the waterproof hood 2. A completely-retaining projection $1f_1$ for the slider 8 is formed on a lower side of the rear half portion, and provisionally-retaining projections $1f_2$ are formed respectively on opposite sides of this rear half portion.

The front holder 3 includes a front wall 3*a* and a peripheral wall 3*b*. Terminal receiving portions 3*c* of a tubular shape, corresponding respectively to the terminal receiving chambers 17, are formed in the front holder 3, and extend from the front wall 3*a*. Passages (not shown) are formed respectively at opposite side portions of the interior of the front holder 3, and communicate respectively with the through holes 19, and receive the side walls 1*b* of the housing body 1, respectively. Retaining grooves (not shown) for respectively receiving the retaining projections 1*d* of the associated ribs 1*c* are formed in a side wall of each of these passages, and positioning fitting holes 3*d* for respectively receiving the front ends $1c_1$ of the ribs 1*c* are formed respectively at corner portions of the front wall 3*a*. Insertion detection holes 3*e* are formed respectively in right and left side portions of the front wall 3*a*, and communicate respectively with the passages. Insertion detection piece portions 9*a* (described later) of the cam bars 9 are viewable respectively through the insertion detection holes 3*e*.

Figure 5:
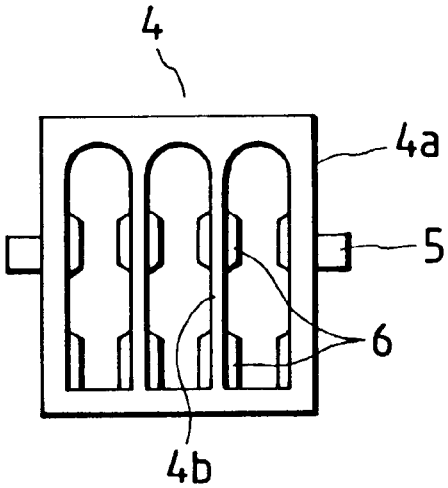
FIG. 5 is a front-elevational view of the terminal retaining member.

The terminal retaining member 4 includes the pair of cam pins 5, and a plurality of projections 6 serving as terminal retaining portions. As shown in FIG. 5, the terminal retaining member 4 includes a frame 4*a* having a plurality of grill bars 4*b* corresponding to the terminal receiving chambers 17. The cam pins 5 are formed respectively on outer surfaces of right and left side walls of the frame 4*a*. The retaining projections 6, corresponding to the upper and lower rows of terminal receiving chambers 17, are formed on opposite sides of the grill bars 4*b*. The grill bars 4*b* constitute part of side walls of the terminal receiving chambers 17.

As shown in FIG. 2(A), when the terminal retaining member 4 is in a lowermost position, terminal insertion passages, which are formed between the upper and lower rows of retaining projections 6 and between the upper row of retaining projections 6 and an upper wall of the frame 4*a*, communicate respectively with the terminal receiving chambers 17. Accordingly, the female terminals 12 can be inserted respectively through the terminal insertion passages.

As described above, the pair of cam bars 9 and 9 projects forwardly from the slider 8 and parallel to the axes of the terminals. The cam groove 10 is formed in an inner surface of the front end portion of each cam bar 9, and the insertion detection piece portion 9*a* is formed integrally with and projects forwardly from the front end of the cam bar 9 at a lower side of the cam groove 10.

Figure 3A:
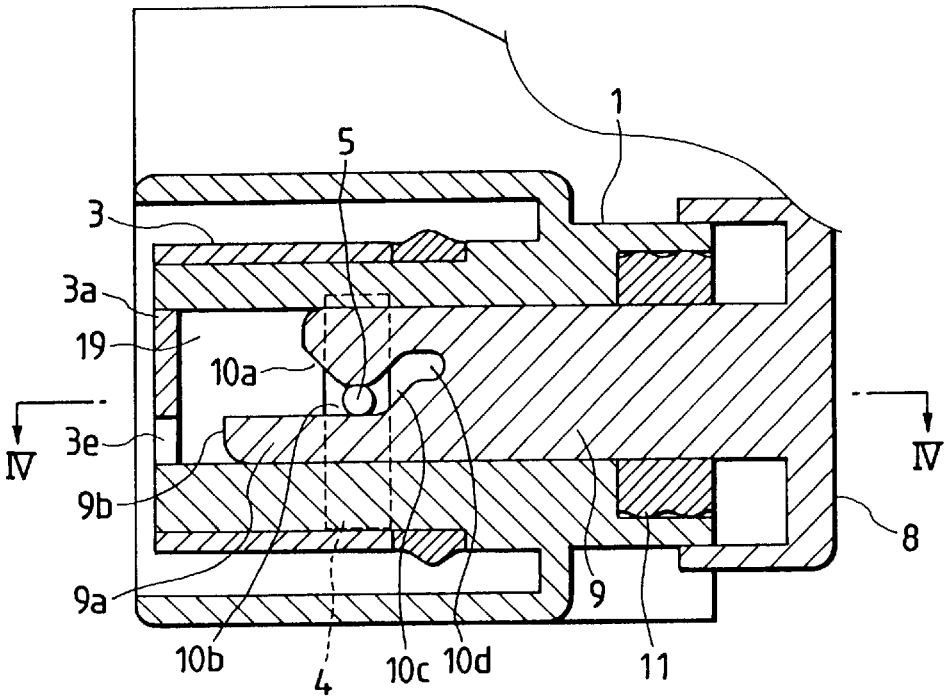
FIGS. 3(A) and 3(B) are vertical cross-sectional views showing a cam bar portion of a terminal retaining member of the connector of FIG. 1, FIG. 3(A) showing a condition before the retaining is effected, and FIG. 3(*b*) showing a condition after the retaining is effected.
Figure 3B:
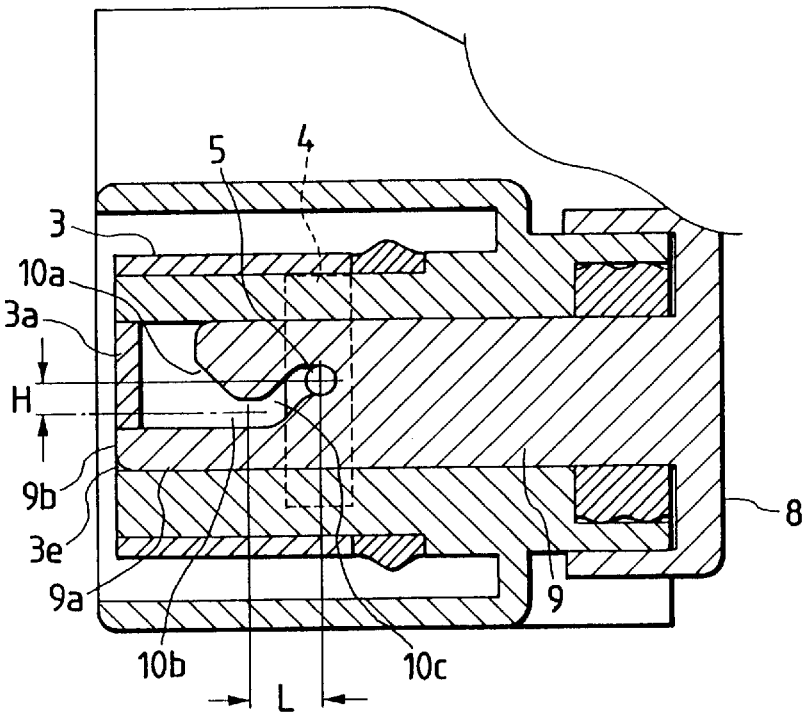

As shown in FIGS. 3(A) and 3(B), the cam groove 10 has a flared introduction portion 10*a* at a front end thereof. A lowermost portion 10*b* extends from the introduction portion 10*a* to a slanting portion 10*c* which leads to an uppermost portion 10*d* at a rear end of the cam groove 10. The lowermost portion 10*b* and the uppermost portion 10*d* are horizontal, parallel to the axes of the terminals, and spaced apart a distance H from each other. The slanting portions 10*c*, when engaged to the cam pins 5, respectively, function to move the terminal retaining member 4 upward and downward in a direction perpendicular to the axes of the terminals.

A waterproof rubber plug 11, having a plurality of wire insertion holes 11*a* corresponding respectively to the terminal receiving chambers 17, is mounted in the slider 8, and elastic lock arms 16 for the housing body 1 are formed respectively on opposite sides and a lower side of the slider 8.

The assembling of the connector A will now be described.

First, the packing 7 is fitted onto the reduced-size portion 1*a* of the housing body 1. In this condition, the terminal retaining member 4 is inserted between the opposite side walls 1*b* and 1*b*, and the front holder 3 is fitted onto the housing body 1 by sliding the side walls 1*b* along the passages in the front holder 3, until the front ends $1c_1$ of the ribs 1*c* are inserted into the positioning fitting holes 3*d* and the retaining projections 1*d* on the ribs 1*c* are engaged in the retaining grooves provided in the passages. In this way, the front holder 3 is locked to the housing body 1. As a result, the terminal retaining member 4 is held between the front holder 3 and the housing body 1 in such a manner that the terminal retaining member 4 can be moved upward and downward, as shown in FIG. 2.

The slider 8 is attached to the rear end portion of the housing body 1 by inserting the cam bars 9 through the through holes 19. When each cam bar 9 is inserted into a position shown in FIG. 3(A), retaining holes 16*a*, formed respectively in the lock arms 16 of the slider 8, are engaged respectively with the provisionally-retaining projections $1f_2$ (see FIG. 4), so that the slider 8 is provisionally locked to the housing body 1. At the same time, each of the cam pins 5 slides along the wall of the flared introduction portion 10*a* of the associated cam groove 10, and is brought into the lowermost portion 10*b*, such that the terminal relating member 4, a stand-by position. In the stand-by position, the terminal insertion passages at the terminal retaining member 4 communicate with the terminal receiving chambers 17. Therefore, the female terminals 12 can be inserted.

In the provisionally-locked condition or stand-by condition of the slider 8, when the female terminal 12 is passed through the associated wire insertion hole 11*a* in the waterproof rubber plug 11 and into the associated terminal receiving chamber 17, a retaining projection 18*a* of the elastic retaining arm 18 engages a rear shoulder 14 of the electrical contact portion 12A of the female terminal 12, thereby effecting the first retaining means (see FIG. 2(B)).

After the first retaining means is effected, the second retaining means is effected by further inserting the cam bars 9 of the slider 8 into the through holes 19. As a result, the cam pins 5 move along the cam grooves 10, through the lowermost portion 10*b*, upwardly along the slanting portion 10*c*, and into the uppermost portion 10*d*. Accordingly, the terminal retaining member 4 moves from the stand-by position into a retaining position, such that the retaining projections 6 of the terminal retaining member 4 engage the opposite sides of the rear shoulder 14 of the electrical contact portion 12A of each female terminal 12 (see FIG. 4).

When the cam bars 9 are further inserted, the cam pin 5 eventually abuts to a rear end of the uppermost portion 10*d* of the cam groove 10. In this position, a retaining hole 16*a* in the lower lock arm 16 is engaged with the completely-retaining projection $1f_1$, thereby completely locking the slider 8 to the housing body 1.

Therefore, when the slider 8 is completely locked, the second retaining means is positively effected, which can easily be visually confirmed from the rear side of the connector A. Also, in the completely-locked condition, the insertion detection piece portions 9*a* are inserted into the insertion detection holes 3*e* in the front wall 3*a* of the front holder 3, such that end surfaces 9*b* of the insertion detection piece portions 9*a* are flush with the outer surface of the front wall 3*a* as shown in FIG. 3(B). Therefore the completely-locked condition can be confirmed from the front side of the connector A.

In the above embodiment, although the cam bars 9 are formed integrally with the slider 8 which substantially constitutes the rear end portion (rear housing) of the connector housing, an arrangement may be used in which an annular detection member is provided between the housing body 1 and the rear housing (slider 8) or at the rear side of the rear housing. In such an arrangement, the cam bars 9 are formed on and project from the annular detection member.

If effecting the second retaining means is to be detected by this detection member, it is necessary to displace the cam bars 9 by a distance L in order to displace the terminal retaining member 4 by a distance H. Since L is much larger than H, the detection is easily made.

Although the cam groove 10 is formed in each cam bar 9 so as to push the cam pin 5 upward, it not always necessary to provide such a groove for pushing the cam pin 5 upward. Accordingly, the groove may be replaced by a slanting slide surface.

Figure 6:
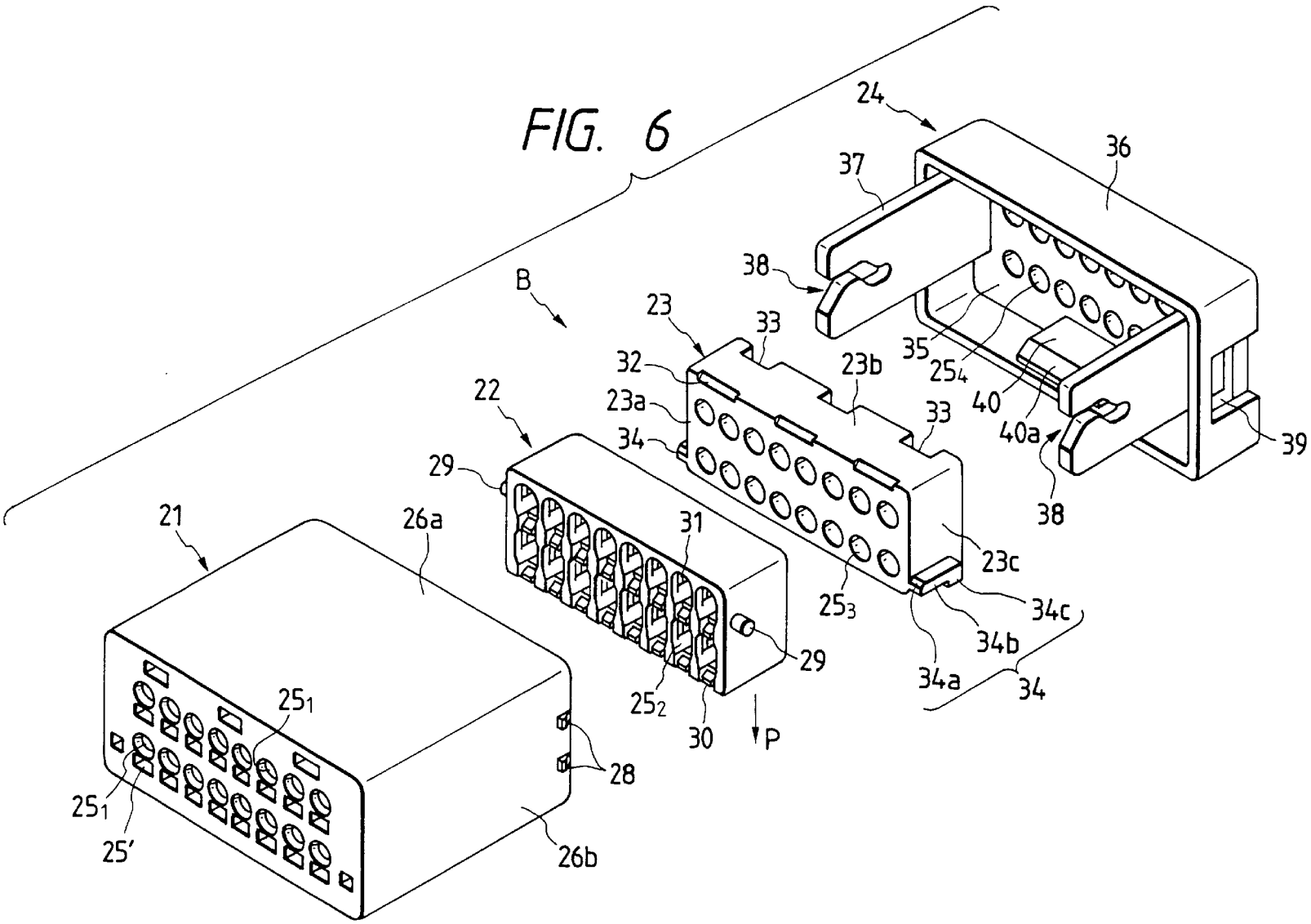
FIG. 6 is an exploded, perspective view of a second embodiment of a double-retaining connector B of the invention.

FIG. 6 shows a second embodiment of the present invention. A connector B of FIG. 6 comprises a housing body 21 having a plurality of terminal receiving chambers $25_1$ arranged in two (upper and lower) rows, a terminal retaining member 22 and a rear holder 23, which are received in a rear half portion of the housing body 21, and a slider (detection member) 24. Each of these constituent members 22 to 24 has a plurality of terminal receiving portions $25_2$, $25_3$, $25_4$ corresponding respectively to the terminal receiving chambers $25_1$. The corresponding terminal receiving portions and terminal receiving chamber jointly form a terminal receiving chamber 25. A jig insertion hole 25', used for withdrawing a terminal, is provided in each of the terminal receiving chambers 25.

Figure 9:
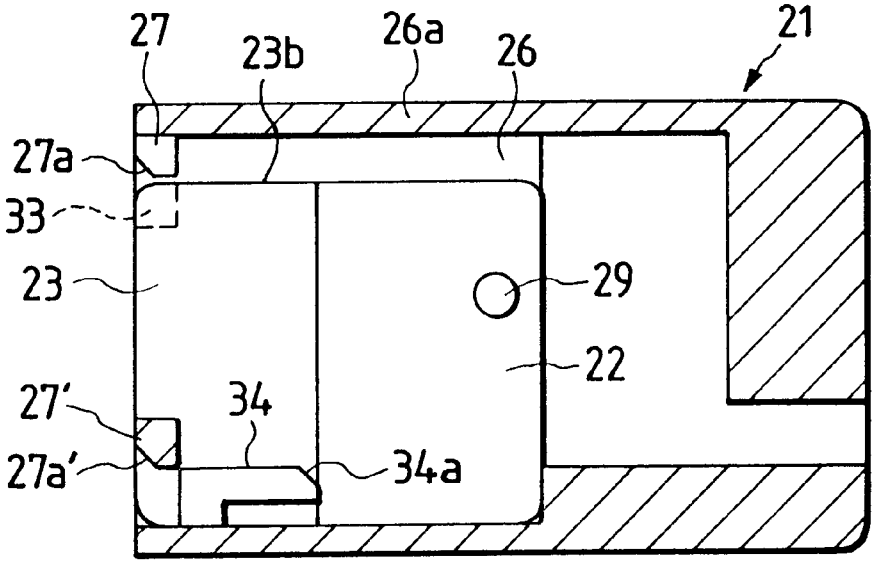
FIG. 9 is a view explanatory of a step of assembling the connector B.

The housing body 21 has the plurality of terminal receiving chambers $25_1$ at its front portion, and a cavity 26 is formed in a rear portion of the housing body 21 as shown in FIG. 9, and the terminal retaining member 22 and the rear holder 23 are received in this cavity 26. A plurality of (three in the illustrated embodiment) lock projections 27 are formed on an upper wall 26*a* at an open end of the cavity 26, and a lock projection 27' is formed at a lower portion of each of opposite (right and left) walls 26*b*. Each of the lock projections 27 and 27' has an insertion guide slanting surface 27*a*, 27*a*'. Retaining projections 28 for engaging retaining windows 39 (described later) in the slider 24 are formed on the outer surfaces of the opposite side walls 26*b*.

Figure 7:
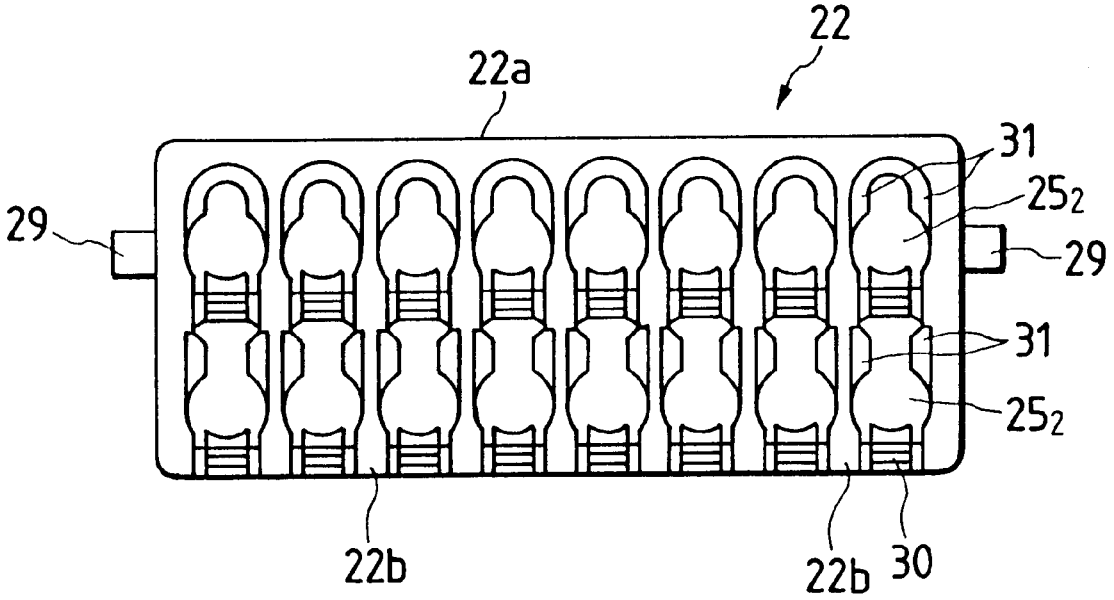
FIG. 7 a front-elevational view of a terminal retaining member 22 of the connector of FIG. 6.

As best shown in FIG. 7, the terminal retaining member 22 has the plurality of terminal receiving portions $25_2$ and a pair of cam pins 29, and an elastic retaining arm 30 (see FIG. 14) and retaining projections 31 for the female terminal 12 are provided in each of the terminal receiving portion $25_2$.

More specifically, the terminal retaining member 22 includes a frame 22*a* having a plurality of grill bars 22*b*. The terminal receiving portions $25_2$ are arranged in two (upper and lower) rows. The cam pins 29 are formed respectively on outer surfaces of opposite (right and left) side walls of the frame 22*a*. The retaining projections 31 (for providing second retaining means) are formed on inner surfaces of the opposite side walls of the frame 22*a* and opposite sides of the grill bars 22*b*, and are disposed in the upper and lower rows of terminal receiving portions $25_2$. This construction is similar to that of the above-mentioned terminal retaining member 4, but the frame 22*a* is thicker than the frame 4*a*, and with respect to each terminal receiving portion $25_2$, the elastic retaining arm 30 is formed integrally with the frame 22*a* at a side wall of each terminal receiving portion $25_2$ remote from the retaining projections 31.

Figure 8:
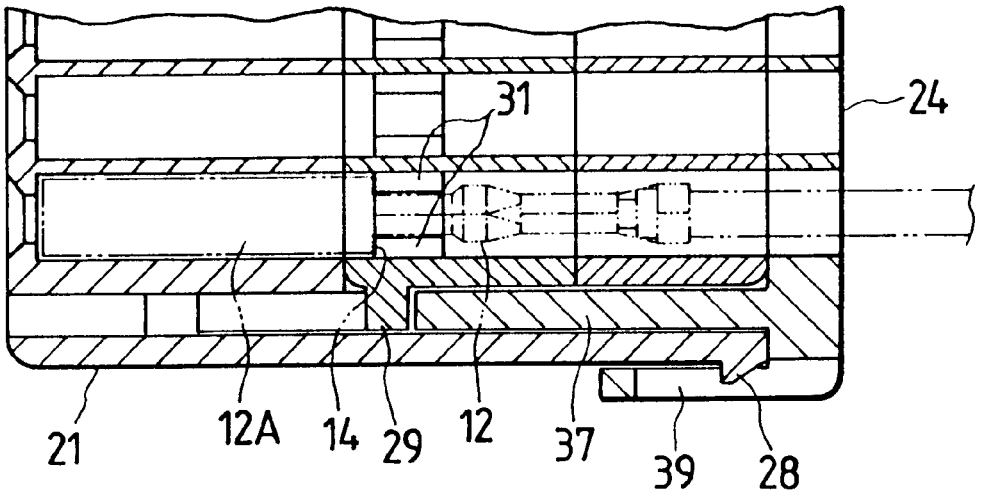
FIG. 8 is a fragmentary, cross-sectional view showing a double-retained condition of the terminal by the terminal retaining member 22.

When the slider 24 is pushed into a retaining position, the terminal retaining member 22 is moved downward in a direction of arrow P. As shown in FIG. 8, the opposed retaining projections 31 engage a rear shoulder 14 of an electrical contact portion 12A of the female terminal 12, thereby effecting the second retaining means.

The rear holder 23 of a rectangular parallelepiped shape has the plurality of terminal receiving portions $25_3$. A plurality of insertion guide slanting surfaces 32 are formed at an upper edge of a front surface 23*a* of the rear holder 23, and similarly slanting surfaces 32' (see FIG. 10) are formed at a lower edge of a rear surface 23*d*. A plurality of lock grooves 33 are formed at a rear edge of an upper surface 23*b*, and fixing lock arms 34 of a hook-shape are formed respectively at lower portions of right and left side surfaces 23*c*. The fixing lock arm 34 includes a horizontal guide projection 34*b* having a slanting surface formed at its front end, and a vertical shoulder 34*c* formed at a rear end, and a rear end surface of the shoulder 34*c* is spaced from the rear surface 23*d* of the rear holder 23 by an amount equal to the depth of the lock groove 33.

The slider 24 includes a rear wall 35 having the plurality of terminal receiving portions $25_4$, and a peripheral wall 36 formed on an peripheral edge of the rear wall. The slider 24 also serves as a cover member. The slider 24 is fitted onto the rear end of the housing body 21. As in the above-mentioned slider 8, a pair of cam bars 37, each having a cam groove 38, are formed on and project from the rear wall 35. The retaining windows 39 for engagement with the retaining projections 28 are formed respectively in right and left sides of the peripheral wall 36. A positioning plate 40 for the rear holder 23 is formed on and projected from a lower portion of the rear wall and a slanting surface 40*a* is formed at a distal end of the positioning plate 40.

Figure 10:
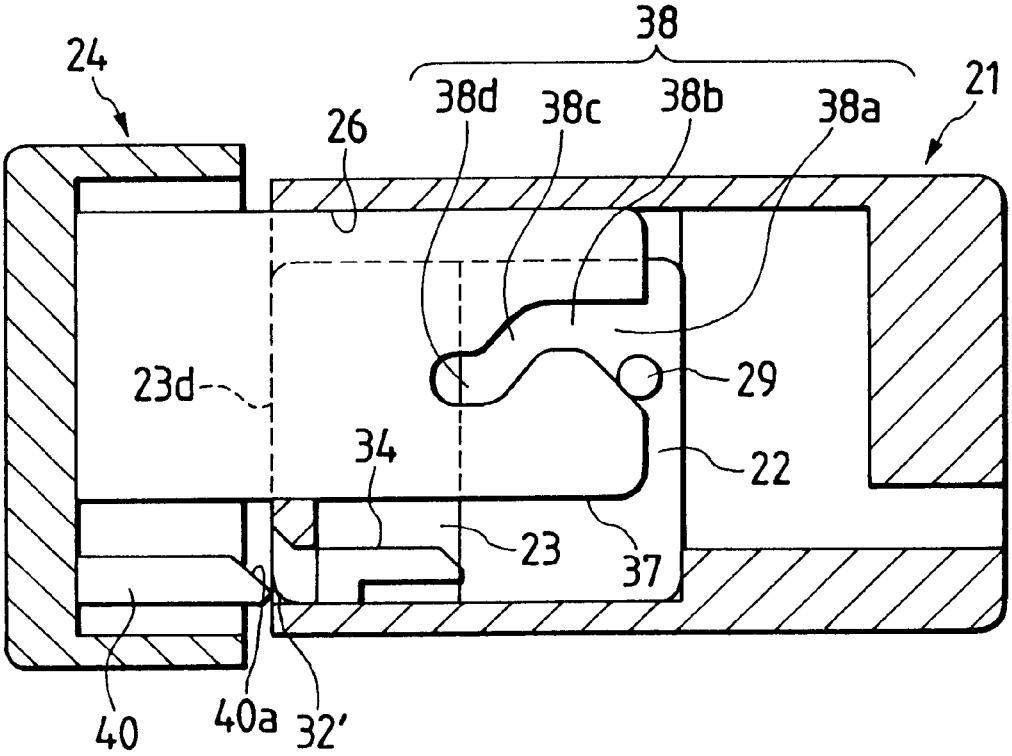
FIG. 10 is a view explanatory of an assembling step (insertion of a slider 24) next to the step of FIG. 9.

The cam groove 38 in the slider 24 is inverted with respect to the cam groove 10. As shown in FIG. 10, the cam groove 38 has a flared introduction portion 38*a* at a front end thereof. An uppermost portion 38*b* extends from the introduction portion 38*a* to a slanting portion 38*c* which leads to a lowermost portion 38*d* at a rear end of the cam groove 38.

The assembling of the connector B will now be described with reference to FIGS. 9 to 12.

First, as shown in FIG. 9, the terminal retaining member 22 and the rear holder 23 are sequentially inserted into the cavity 26 in the rear portion of the housing body 21. Although the lock projections 27 and 27' are provided at the open end of the cavity 26, the slanting surfaces 27*a* and 27*a*' are brought into slidable contact with the slanting surfaces 32 at the front surface of the rear holder 23 and the slanting surfaces 34*a* of the fixing lock arms 34. Therefore, the inserting operation is effected smoothly.

Then, the slider 24 is attached to the rear end of the housing body 21 as shown in FIG. 10. More specifically, when the cam bars 37 are inserted respectively into a gap (in the cavity 26) between the rear holder 23 and the right side wall 26*b* and a gap (in the cavity 26) between the rear holder 23 and the left side wall 26*b*, the wall of the flared introduction portion 38*a* of each of the cam grooves 38 impinges on the associated cam pin 29 of the terminal retaining member 22 located in its lowermost position. At the same time, the front end of the positioning plate 40 is brought into contact with the rear surface 23*d* of the rear holder 23.

Figure 11:
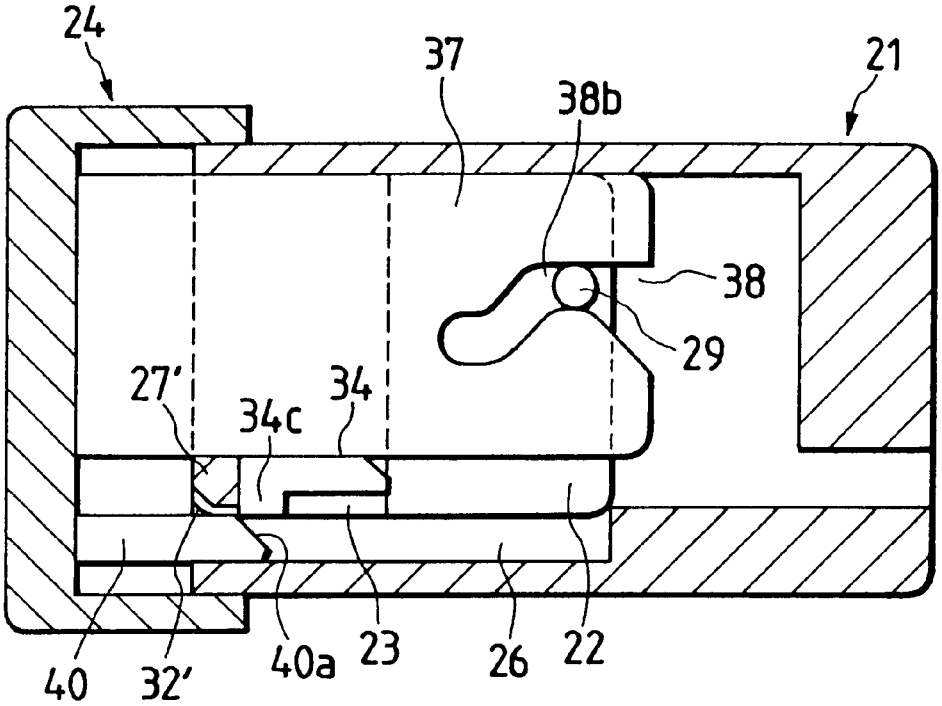
FIG. 11 is a view explanatory of an assembling step (stand-by position of the terminal retaining member 22) next to the step of FIG. 10.
Figure 12:
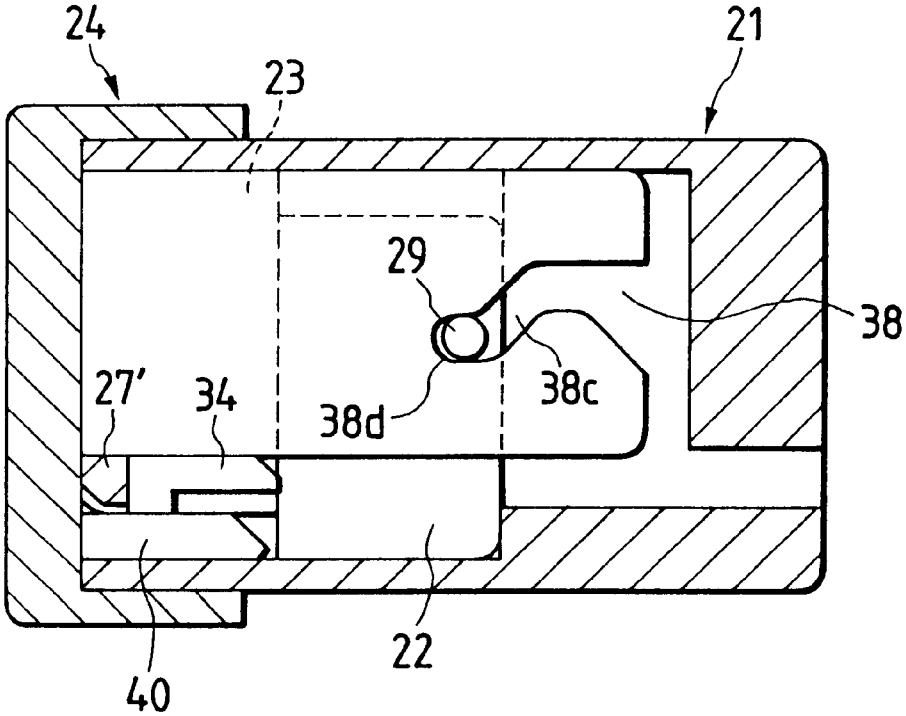
FIG. 12 is a view explanatory of an assembling step (retaining position of the terminal retaining member 22) next to the step of FIG. 11.
Figure 13:
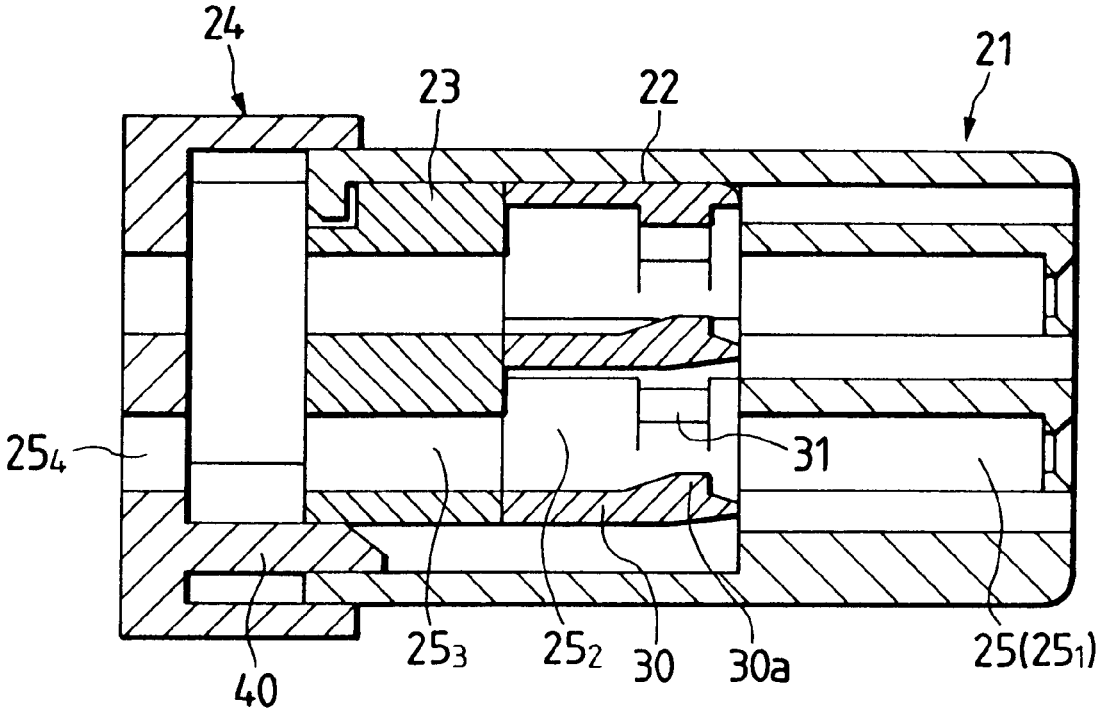
FIG. 13 is a cross-sectional view of the connector B, corresponding to FIG. 10 and showing the stand-by position of the terminal retaining member 22.

When the cam bars 37 are further inserted, each cam pin 29 slides upwardly along the wall of the groove, and is once held on the uppermost portion 38*b*, so that the terminal retaining member 22 is held in an uppermost position, that is, a stand-by position, as shown in FIG. 11.

Simultaneously with the upward movement of the terminal retaining member 22, the rear holder 23 is raised into the same level as that of the terminal retaining member 22 by the positioning plate 40 through the sliding contact between the slanting surfaces 32' and 40*a*. As a result, the terminal receiving chambers $\mathbf{25}_1$, the terminal receiving portions $\mathbf{25}_2$, $\mathbf{25}_3$ and $\mathbf{25}_4$ of the housing body 21, the terminal retaining member 22, the rear holder 23 and the slider 24, respectively, are aligned with one another, thereby forming the terminal receiving chambers 25. Accordingly, the female terminals 12 can be inserted into and withdrawn from these terminal receiving chambers 25. Although the elastic retaining arms 30 of the terminal retaining member 22 face the terminal receiving chambers 25, respectively, the retaining portions 31 are not received in the terminal receiving chambers 25. Then, when the female terminal 12 is inserted into the terminal receiving portion $\mathbf{25}_4$ from the rear end, the electrical contact portion 12A of this terminal advances and forces the elastic retaining arm 30 to bend upwardly or downwardly. When the terminal is completely inserted, the elastic retaining arm 30 is elastically restored, so that a retaining projection 30*a* of this arm 30 engages the rear shoulder 14 of the electrical contact portion 12A, thereby effecting the first retaining means (see FIG. 8).

To withdraw the female terminal 12, a jig, such as a screw driver, is inserted into the jig insertion hole 25' in the housing body 12 to disengage the retaining projection 30*a* from the rear shoulder 14.

When the rear holder 23 is raised, the retaining projections 27 on the housing body 21 are engaged respectively in the lock grooves 33 in the upper surface 23*b* of the rear holder 23 (see FIG. 9). The retaining projections 27' serve as stoppers for the shoulders 34*c* of the fixing lock arms 34. Therefore the slider 24 is, together with the terminal retaining member 22 and the rear holder 23, provisionally locked relative to the housing body 1.

Figure 14:
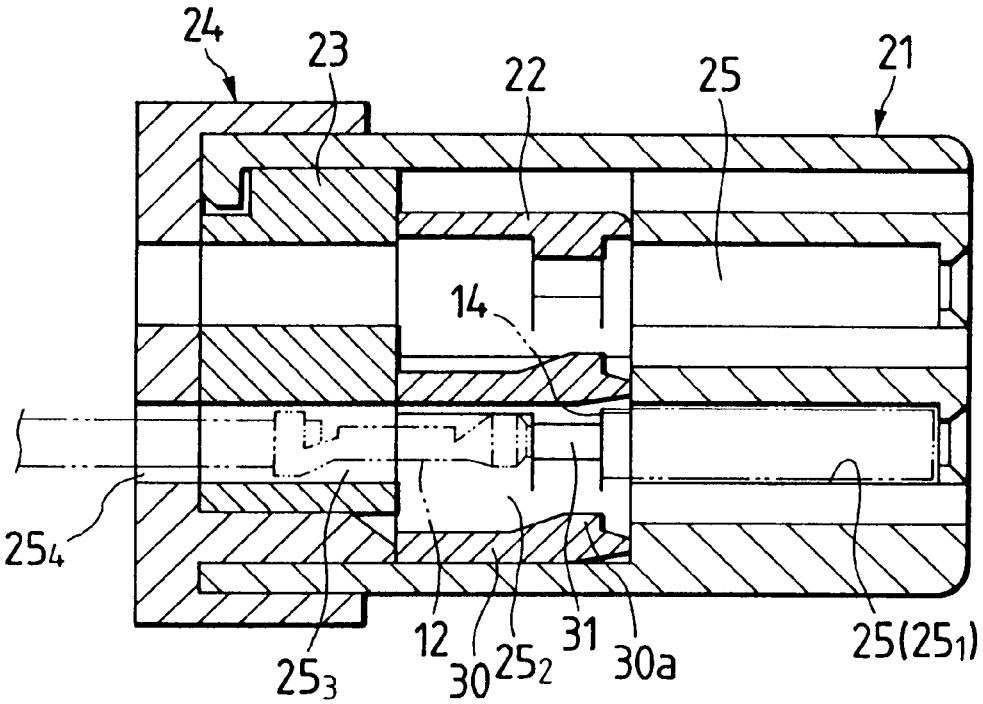
FIG. 14 is a cross-sectional view of the connector B, corresponding to FIG. 11 and showing the retaining position of the terminal retaining member 22.
Figure 15A:
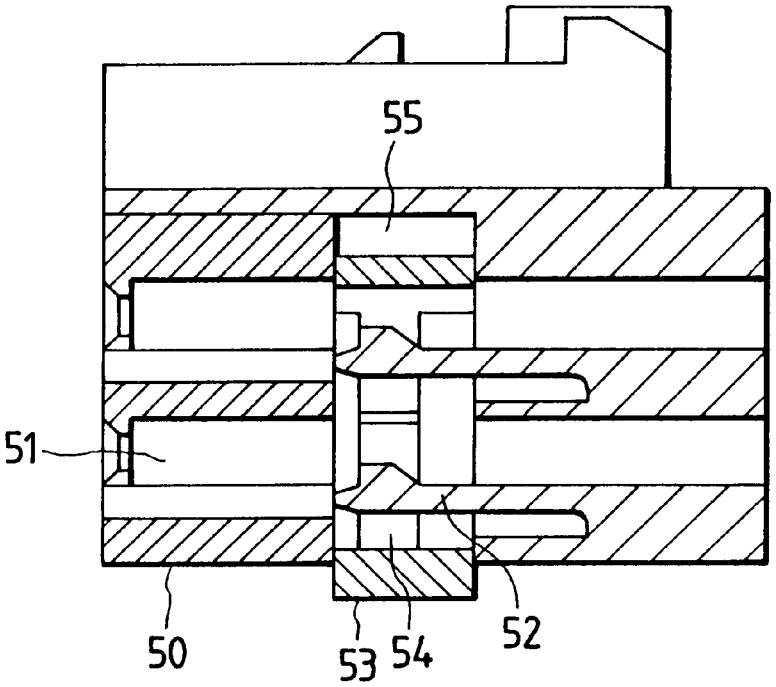
FIG. 15(A) PRIOR ART
FIG. 15(A) is a cross-sectional view of a conventional double-retaining connector before the retaining is effected.
Figure 15B:
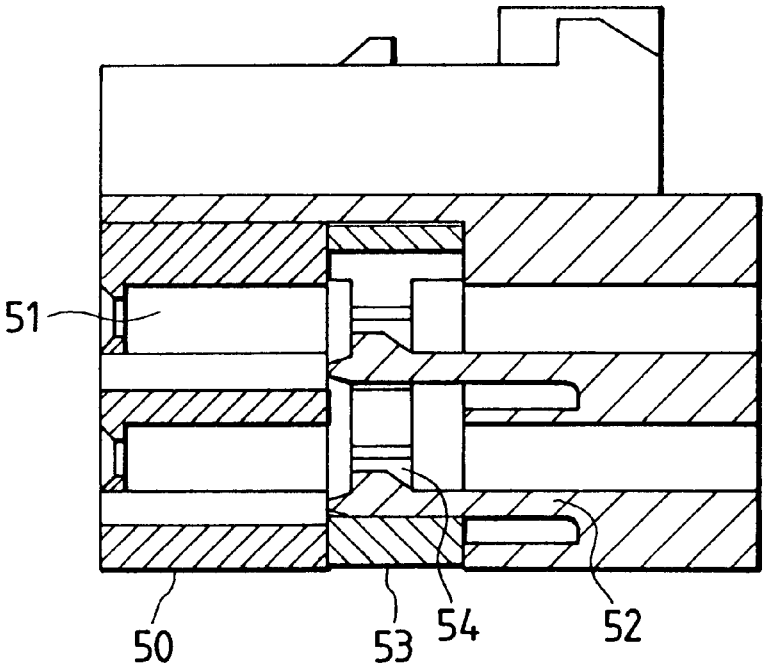
FIG. 15(B) PRIOR ART
FIG. 15(B) is a cross-sectional view of the conventional connector after the retaining is effected.

After each female terminal 12 is completely inserted, the cam bars 37 are further inserted, such that each cam pin 29 slides downward along the slanting portion 38*c* of the associated cam groove 38 into the lowermost portion 38*d*, causing the terminal retaining member 22 to move to the lowermost retaining position. As a result, the retaining projections 31, provided at the opposite sides of each terminal receiving portion $\mathbf{25}_2$, engage the rear shoulder 14 at a narrow neck portion 13 of the female terminal 12, thereby effecting the second retaining means, as shown in FIGS. 8 and 14.

Once the cam bars 37 are fully inserted, the retaining windows 39 of the slider 24 engage the retaining projections 28 on the housing body 21, thereby completely locking the slider 24 to the housing body 21. During this operation, each cam pin 29, received in the horizontal lowermost portion 38*d*, is not moved upward and downward.

In the second embodiment, as in the first embodiment, it is necessary to displace the cam bars 37 by a distant L in order to displace the terminal retaining member 22 by a distance H. Since L is much larger than H, the detection is made easy.

As in the first embodiment, an insertion detection piece portion may be formed at the front end of each cam bar 39, and insertion detection holes may be formed in the front wall of the housing body 21.

The present invention provides the following advantages. The cam pins are formed on the terminal retaining member, and the cam bars, each having the slanting slide surface or cam groove, are inserted from the rear end of the connector housing, and as a result the slide surfaces or cam grooves contact the cam pins, respectively, to move the terminal retaining member in a direction perpendicular to the axes of the terminals, thereby retaining the terminals. Therefore, the distance (insertion stroke) of insertion of the cam bars for retaining the terminals is increased, and the visual confirmation is easy. Therefore, determining whether or not the terminals are properly retained by the terminal retaining member can be judged easily, and the incomplete retaining and the failure to effect the retaining means are prevented.

In claim 2, the provisionally-locking means for retaining the terminal retaining member in the stand-by position, as well as the completely-locking means for retaining the terminal retaining member in the retaining position, are provided at the connector housing and the detection member. Therefore, the terminals can be inserted and withdrawn, with the detection member remains attached to the connector housing to ease handling. Further, after the terminals are inserted, the withdrawal of the terminals is positively prevented by the completely-locking means.

The insertion detection piece portion is formed at the distal end of each of the cam bars of the detection member, and the insertion detection holes are formed in the front wall of the connector housing. In the completely-locked position of the detection member, the distal ends of the insertion detection piece portions are inserted respectively through the insertion detection holes, and can be viewed from the exterior. Therefore, whether or not the detection member is properly mounted, as well as whether or not the terminals are properly retained, can be judged from the front and rear sides of the connector housing.

The connector housing is constituted by several separate parts (that is, the housing body and the front holder, or the housing body, the terminal retaining member and the rear holder). Therefore, molds for forming the connector housings are simplified in construction, and the molding of the connector housing, having the terminal receiving chambers of a complicated shape, can be simplified.

The terminal retaining member has the elastic retaining arms for respectively engaging the terminals to effect the first retaining means. Each of the elastic retaining arms is provided at one side of the associated terminal receiving portion remote from the terminal retaining portions. Therefore, the molds are further simplified in construction, and dimensional accuracies can be enhanced.

The front end portion of the cam groove is larger than the groove width, and therefore the terminal retaining member is brought into the stand-by position by slightly inserting the cam bars irrespective of the position of the terminal retaining member, and each terminal can be easily inserted into the terminal receiving chamber.

The detection member also serves as the rear housing constituting the rear end portion of the connector housing, and the cam bars are formed on the rear housing. Therefore, the number of the component parts of the connector housing is reduced, and time and labor required for an assembling operation are reduced.

The retaining means for retaining the rear housing on the connector housing also serves as the lock means for locking the terminal retaining member, the cam bars are retained simultaneously when the rear housing is retained, such that the construction of the connector is simplified.

What is claimed is:

1. A connector comprising:

a connector housing having terminal receiving chambers each having opposite open ends;

a terminal retaining member, having terminal receiving portions and terminal retaining portions, mounted in an intermediate portion of said connector housing, said terminal retaining member being disposed substantially perpendicular to axes of terminals received respectively in said terminal receiving chambers;

cam pins formed respectively on opposite side surfaces of said terminal retaining member; and a detection member removably attached to a rear end of said connector housing, said detection member having cam bars each having a slanting slide surface for engagement with the associated cam pin;

wherein said terminal retaining member is movable between (1) a stand-by position where said terminal receiving portions communicate respectively with said terminal receiving chambers, and said terminal retaining portions are disposed outside said terminal receiving chambers so as to enable the insertion and withdrawal of said terminals, and (2) a retaining position where said terminal retaining portions are received in said terminal receiving chambers, and engage said terminals; and wherein in a condition in which said cam pins are engaged respectively with said slide surfaces, a short-distance movement of said terminal retaining member from said stand-by position into said retaining position is effected through a long-distance movement of said detection member in a direction parallel to the axes of said terminals.

2. A connector according to claim 1, further comprising provisionally-locking means for retaining said terminal retaining member in said stand-by position, and completely-locking means for retaining said terminal retaining member in said retaining position, said provisionally-locking means and said completely-locking means being provided at said connector housing and said detection member.

3. A connector according to claim 1, further comprising an insertion detection piece portion is formed at a distal end of each of said cam bars of said detection member, and insertion detection holes are formed in a front wall of said connector housing, and in a completely-locked position of said detection member, distal ends of said insertion detection piece portions are inserted respectively in said insertion detection holes, and can be viewed from the exterior.

4. A connector according to claim 1, wherein said connector housing comprises a housing body having the terminal receiving chambers, and a front holder removably mounted on a front end portion of said housing body, said front holder having terminal receiving portions communicating respectively with said terminal receiving chambers; and wherein said terminal retaining member is movably mounted between said housing body and said front holder, and said housing body has through holes into which said cam bars are removably inserted from a rear side thereof, respectively.

5. A connector according to claim 1, wherein said connector housing comprises:

a housing body having terminal receiving chambers at its front portion and a cavity at its rear portion;

said terminal retaining member; and a rear holder, wherein said rear holder and said terminal retaining member are received in said cavity, each of said terminal retaining member and said rear holder has terminal receiving portions communicating respectively with said terminal receiving chambers in said housing body, and said cam bars of said detection member are removably inserted respectively into a gap between one side wall of said cavity and said rear holder and a gap between the other side wall of said cavity and said rear holder.

6. A connector according to claim 4, wherein said terminal retaining member has elastic retaining arms for respectively engaging said terminals to effect the primary retaining of said terminal, and each of said elastic retaining arms is provided at one side of the associated terminal receiving portion remote from said terminal retaining portions.

7. A connector according to claim 1, wherein a cam groove is formed in each of said cam bars, and said cam groove has a slanting slide surface for engagement with the associated cam pin so as to move said terminal retaining member in a direction substantially perpendicular to the axes of said terminals.

8. A connector according to claim 7, wherein a front end portion of said cam groove is formed into a flaring, wide introduction portion for receiving said cam pin.

9. A connector according to claim 1, wherein said detection member also serves as a rear housing constituting a rear end portion of said connector housing, and said cam bars are formed on said rear housing.

10. A connector according to claim 9, wherein retaining means for retaining said rear housing on said connector housing also serves as lock means for locking said terminal retaining member.

* * * * *